United States Patent [19]

Schneider

[11] 4,089,484

[45] May 16, 1978

[54] TAKE-UP FRAME FOR PILE FABRIC

[75] Inventor: Axel Schneider, Krefeld, Germany

[73] Assignee: Scheibler Peltzer & Co., Krefeld, Germany

[21] Appl. No.: 828,419

[22] Filed: Aug. 29, 1977

Related U.S. Application Data

[63] Continuation-in-part of Ser. No. 546,132, Jan. 31, 1975, Pat. No. 4,044,966.

[51] Int. Cl.[2] ..... B65H 75/02

[52] U.S. Cl. ..... 242/77.1; 242/62

[58] Field of Search ..... 242/77.1, 62; 206/49, 206/389, 408, 407

[56] References Cited

U.S. PATENT DOCUMENTS

| | | | |
|---|---|---|---|
| 2,356,787 | 8/1944 | Hellyar | 242/77.1 |
| 3,189,172 | 6/1965 | Williams | 242/77.1 |
| 3,989,203 | 11/1976 | Williams | 242/77.1 |
| 4,044,966 | 8/1977 | Schneider | 242/77.1 |

*Primary Examiner*—Edward J. McCarthy
*Attorney, Agent, or Firm*—Herbert E. Kidder

[57] ABSTRACT

A take-up frame for pile fabric consisting of two suspension frames mounted on opposite ends of a cylindrical shaft, each frame comprising a plurality of angularly spaced arms projecting radially from a central hub. Each of the arms has a narrow slot formed in the side facing away from the other frame. The slot extends lengthwise of the arm and extends only part way through the thickness of the arm. A plurality of slot-like apertures extends through the remaining thickness of the arm from the bottom of the slot to the other side of the arm. The slot-like apertures are spaced apart equidistantly from one another along the length of the slot. Inserted into the slot is a hook band consisting of a plurality of hooks joined together and spaced apart from one another the same distance as the space between the slot-like apertures. Each of the hooks passes through its respective slot-like aperture and projects from the other side of the arm, where it is adapted to hook onto the edge of the pile fabric. The slot-like aperture provides back-up support for the hook on all sides, so that the hook is greatly strengthened. In one form of the invention, the hooks are joined to a continuous base strip that abuts against the bottom of the slot to limit the depth of insertion of the hook band. In another form, the hooks are detachably connected together by first and second fastener means. The first fastener means limits the depth of insertion of the hook band so that the hooks are retracted until broken free and pushed inwardly by impact. The second fastener means engages the bottom of the slot after the hook has been detached, to limit the depth of insertion of the hook.

5 Claims, 5 Drawing Figures

FIG. 2.
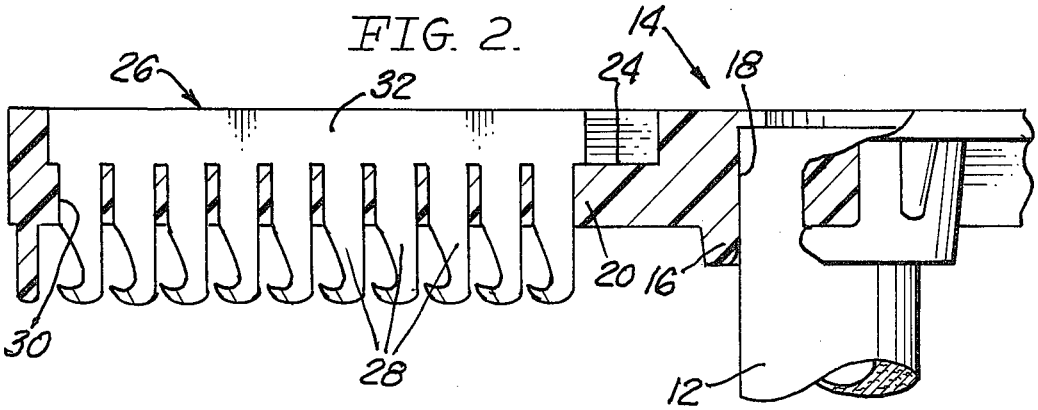
FIG. 4.
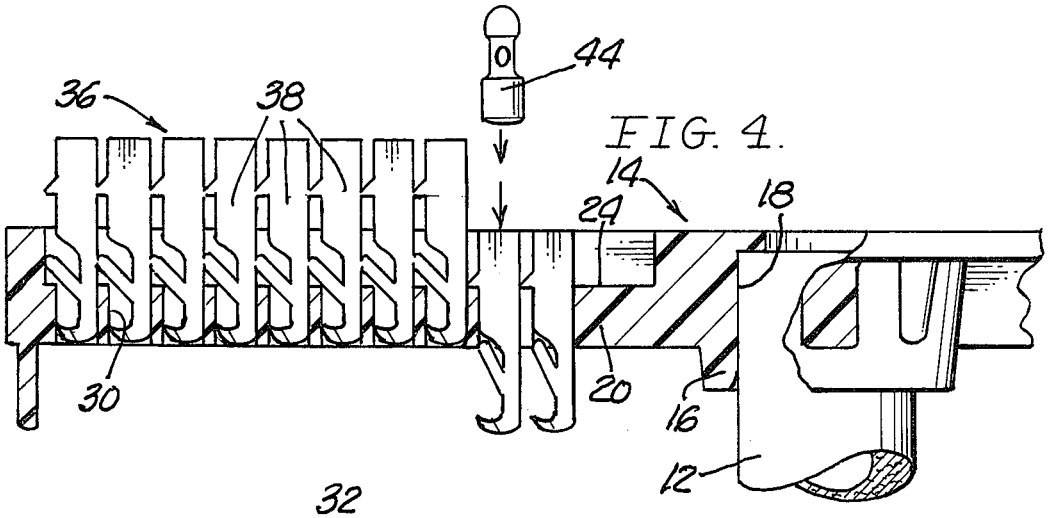
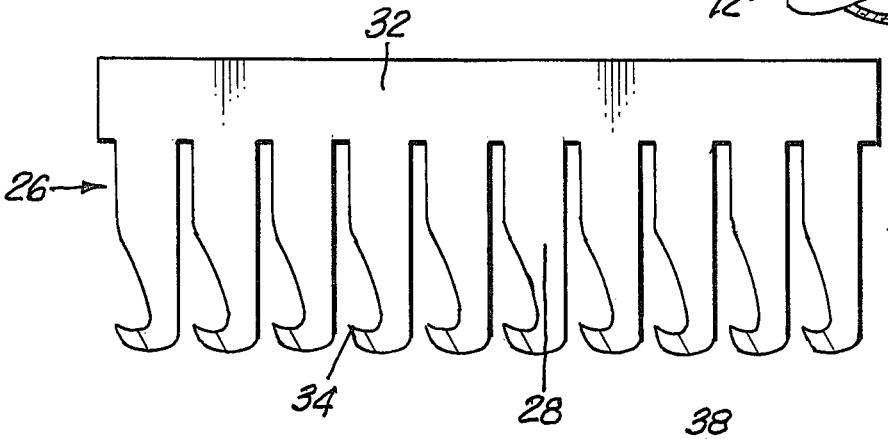
FIG. 3.
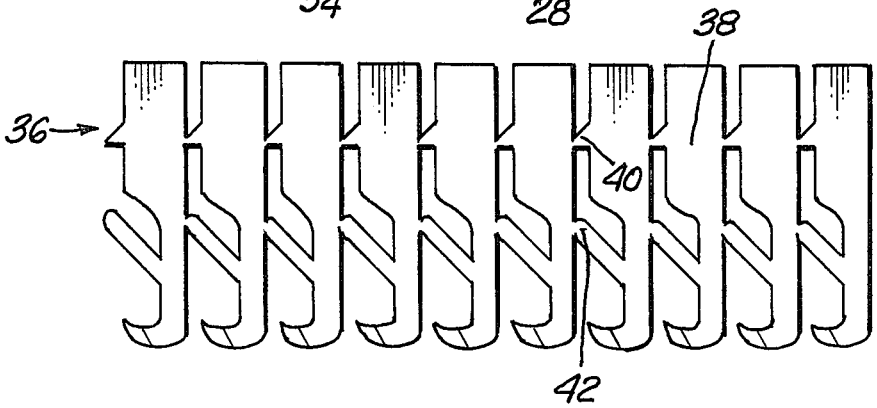
FIG. 5.

TAKE-UP FRAME FOR PILE FABRIC

This application is a continuation-in-part of my pending application Ser. No. 546,132, filed Jan. 31, 1975, now Pat. No. 4,044,966.

The present invention pertains to take-up frames for pile fabric, and more particularly to an arrangement consisting of two suspension frames mounted on opposite ends of a shaft, each of which is provided with radially extending hook bands to which the edges of the fabric web are hooked. The fabric web is wound spirally around the shaft, with each layer separated by an air space from the adjacent layers, so that the pile is not crushed or matted down when the fabric is being transported. These suspension frames are usually discarded after being used only once, and is therefore necessary that they be made as inexpensive as possible. The suspension frames are usually molded of an inexpensive plastic, but it has been found that the plastic used for the frames is too soft for use as the hook bands, and a harder material is required to form sharp-pointed hooks that will be strong enough to withstand the stresses and strains of usage. The hook bands are therefore made of a stronger and harder plastic, which takes and holds a sharp point.

The primary object of the present invention is to provide a new and improved suspension frame molded of plastic and having a central hub with radially projecting arms, each of which arms has a narrow radial slot formed therein into which the hook band is inserted, with each of the hooks passing through a separate slot-like aperture that provides support and backing for the hooks. In one form of the invention, the several hooks that form the hook band are solidly connected together, and remain as an integral unit during the entire service life of the hook band. In another form of the invention, the several hooks are detachably connected together by small fastener elements, and are so designed that the hooks are normally retracted into their respective slot-like aperture until each hook is individually struck from the back side of the suspension frame, causing the smaller fastener elements to break away and allow the hook to slide downwardly through its respective aperture until it projects from the other side, so as to hook into the pile fabric. In this latter embodiment, the slot-like enclosures serve as guideways to ensure that each hook moves in the desired direction, and is properly supported and backed up after being broken away from the others. One of the fastener elements serves as a limit stop to position the complete hook band at the correct depth in its slot, while the other fastener element serves as a limit stop to limit the movement of the individual hook after it has been broken away from the others.

The present invention has many advantageous features which will become apparent to those skilled in the art upon consideration of the following detailed description of the preferred embodiment, with reference to the accompanying drawings.

FIG. 2 is an enlarged fragmentary sectional view through one arm of a suspension frame, showing the solidly connected hook bands in the slot;

FIG. 3 is a further enlarged elevational view of the hook band in FIG. 2;

FIG. 4 is a sectional view similar to FIG. 2, showing the suspension frame with a hook band consisting of individual hooks detachably connected together; and FIG. 5 is an enlarged elevational view showing the hook band with detachably connected hooks.

Figure 1:
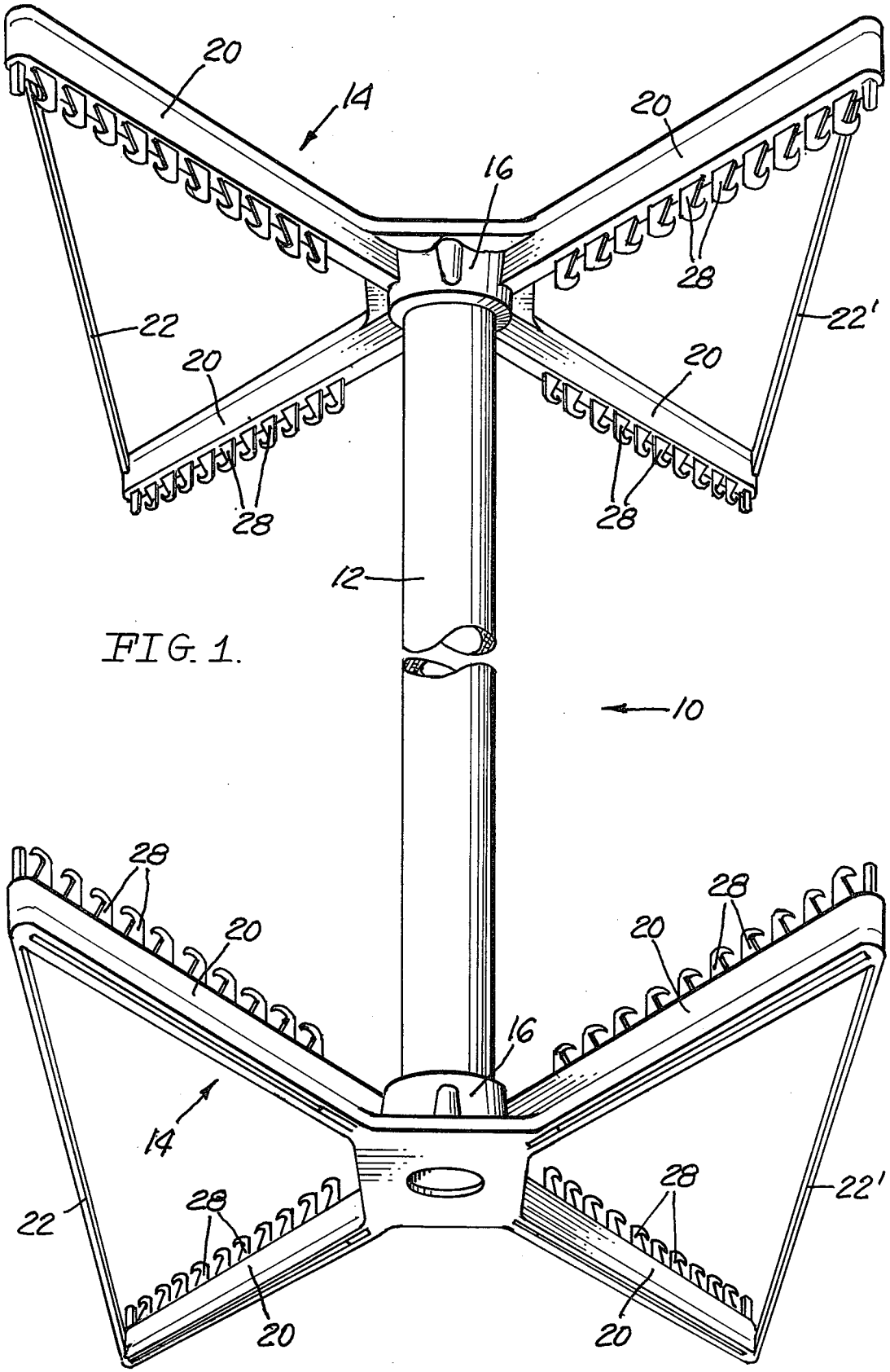
FIG. 1 is a perspective view of a take-up frame assembly embodying the invention.

In FIG. 1, the reference numeral 10 designates a take-up frame consisting of a cylindrical cardboard tube 12 having two X-shaped suspension frames 14 of molded plastic material mounted on opposite ends of the tube. Each of the suspension frames 14 consists of a central hub 16 having a cylindrical socket 18, into which the end of the cardboard tube 12 is inserted.

Projecting radially from the hub 16 and spaced apart 90 degrees from one another are four arms 20. The two arms 20 on the left-hand side of the tube 12 (as seen in FIG. 1) are connected at their outer ends by a reinforcing bar 22, while the two arms on the right-hand side are connected by a bar 22.

Each of the arms 20 has a narrow slot 24 formed in the back side thereof, into which a hook band 26 is inserted; the said hook band having a plurality of hooks 28 along one edge, which project from one side of arm 20. The term "back side" as used herein refers to the side of the suspension frame opposite the projecting hooks. The slot 24 extends to approximately half the depth of the arm 20, and extending through from the bottom of the slot to the front side of the arm is a plurality of radially spaced, slot-like apertures 30. The term "front side" as used herein refers to the side of the suspension frame from which the hooks project. Each of the hooks 28 passes through one of the apertures 30, and the continuous base 32 of the hook band lies within the slot 24, with its bottom edge seated on the bottom of the slot.

As best shown in FIG. 3, the hook band 26 comprises an elongated, continuous base 32, with a plurality of hooks 28 projecting from one edge of the base 32 and spaced apart from one another the same distance as the space between apertures 30. Each of the hooks 28 has a sharp, pointed end 34 that penetrates the pile fabric material when the latter is being wound onto the take-up frame 10.

When the hook band 26 is fully seated within slot 24, each of the hooks 28 passes through and is snugly confined within its own aperture 30. The sides and ends of the apertures 30 thus bear against and provide back-up support for their respective hooks 28, and the hooks are therefore quite rigid with respect to the arms 20. Only that portion of the hook 28 projecting beyond the front side of the arm 20 is subjected to bending stress, and the hook is quite strong in this direction, owing to the fact that its breadth dimension is considerable (e.g., 1/4¼, for example), whereas the thickness dimension might be only 3/32 inch.

In the second form of the invention, illustrated in FIGS. 4 and 5, the hook band 36 does not have a continuous base, but instead consists of a plurality of separate hooks 38 which are spaced apart from one another by a distance equal to the space between the apertures 30. The hooks 38 are detachably connected to one another by small fastener elements 40 and 42. Element 40 is a generally wedge-shaped projection sticking out from the left-hand edge of the hook, with its small end merged into the right-hand edge of the adjacent hook to the left. The terms "left" and "right" as used herein refer to the views as seen in FIGS. 4 and 5. Element 42 is a thin inclined strip of plastic extending upwardly and to the left (as viewed in FIG. 5) until it merges with the right-hand edge of the adjacent hook to the left.

When the hook band 36 is seated within the slot 24, as shown in FIG. 4, the hooks 38 extend into the apertures 30 but do not project beyond the bottom surface (i.e., front side) of the arm. This location of the hook band 36 is determined by the inclined strips 42, each of which abuts against the corner formed by the bottom of slot 24 and the left-hand edge of its respective aperture 30. As hooks are needed for the pile fabric, they are successively knocked down to the operating position shown by the two hooks at the right-hand end of the hook band in FIG. 4. The hooks are knocked down by any impact device, symbolized by a hammer 44 at the back side of the suspension frame, thus enabling the fabric material to be hooked onto the projecting hook 38. Each rotation of fabric material to be hooked onto the projecting hook 38. Each rotation of the take-up frame causes the next outermost hook 38 to be pushed towards the opposite suspension frame and to be thus detached from the hook band 36.

When the hook 38 is pushed down to its operating position, the bottom edge of projection 40 abuts against the bottom of the slot 24, and this prevents the hook from going any further. Thus, fastener element 40 limits the movement of the hook 38 toward the front side of the arm 20 when the hook is thrust down to its operating position, and fastener element 42 limits the insertion of the hook band 36 down into the slot 24. The two fastener elements 40 and 42 are weakened at the points where they join the next adjacent hook to the left, and therefore the fastener elements break free at this point. The inclined strip 42 is flexible enough so that it can bend to pass through the aperture 30, as shown in FIG. 4.

The take-up frame of this invention has many advantageous features. The plastic suspension frames are light in weight, strong and inexpensive, and are suitable for re-use by inserting fresh hook bands. Each of the hooks is securely held in place and is backed up on all sides by contact with the walls of the slot-like apertures 30.

While I have shown and described in considerable detail what I believe to be the preferred form of the invention, it will be understood by those skilled in the art that the invention is not limited to such details, but may take other forms within the scope of the claims.

What I claim is:

1. A take-up frame for pile fabric comprising, in combination;

two spaced-apart suspension frames, each having a central hub with a cylindrical bore provided therein;

a cylindrical shaft extending between said frames and having its ends seated in said cylindrical bores;

each of said frames having a plurality of angularly spaced, radial slots provided therein on the one side facing away from the other frame, said slots extending only part way through the thickness of the frame;

a plurality of slot-like apertures extending through said frames from the bottom of each of said radial slots to the other side of the frame, said slot-like apertures being spaced apart equidistantly from one another along the length of the respective slot;

a hook band inserted into said slot, said hook band comprising a plurality of hooks spaced apart from one another the same distance as the space between said slot-like apertures, said hooks being joined together; and means on said hook band abutting against the bottom of said slot to limit the movement of the hooks toward said other side of the frame, with the hooks projecting from said other side of the frame to engage the pile fabric.

2. A take-up frame as in claim 1, wherein each of said suspension frames has a plurality of angularly spaced arms projecting radially from said central hub, and said slots and said slot-like apertures are formed in said arms.

3. A take-up frame as in claim 1, wherein each of said hook bands comprises an elongated, continuous base with a plurality of hooks projecting from one edge thereof, said hooks being spaced apart from one another the same distance as the space between said slot-like apertures; and said means to limit the movement of the hooks toward said other side of the frame comprises the portions of said base extending between adjacent pairs of hooks, said portions of said base abutting against the bottom of the slot between said slot-like apertures.

4. A take-up frame as in claim 1, wherein said hook bands each comprise a plurality of hooks detachably connected together; means on said hook band limiting the depth of insertion of the hook band into said slot, so that the hooks are retracted below said other side of said suspension frame; said hooks being adapted to be successively detached from said hook band and pushed through their respective slot-like apertures until the hooks project from said other side of the frame; and said means to limit the movement of the hooks toward said other side of the frame consisting of lateral projections on the hooks that abut against the bottom of the slot.

5. A take-up frame as in claim 4, wherein each of said hooks is connected to the next adjacent hook on one side by first and second fastener means; said first fastener means functioning as said means to limit the depth of insertion of the hook band into the slot; and said second fastener means consisting of said lateral projections on the hooks that abut against the bottom of the slot when the hook has been detached from the hook band and pushed through its respective slot-like aperture; said first and second fastener means being adapted to be broken away from the adjacent hook when each hook is impacted.

* * * * *